US008764386B2

(12) United States Patent
Volk

(10) Patent No.: US 8,764,386 B2
(45) **Date of Patent: *Jul. 1, 2014**

(54) BYPASS SYSTEM FOR PURGING AIR FROM A SUBMERSIBLE PUMP

(75) Inventor: James J. Volk, Fort Wayne, IN (US)

(73) Assignee: Franklin Electric Co., Inc., Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/852,049

(22) Filed: Aug. 6, 2010

(65) Prior Publication Data

US 2011/0027072 A1 Feb. 3, 2011

Related U.S. Application Data

(63) Continuation of application No. 11/411,348, filed on Apr. 25, 2006, now Pat. No. 7,794,199.

(60) Provisional application No. 60/683,965, filed on May 24, 2005.

(51) Int. Cl.
*F04D 9/00* (2006.01)

(52) U.S. Cl.
USPC ..... 415/144; 415/169.1; 415/199.2; 415/901; 29/888.02; 29/888.024

(58) Field of Classification Search
USPC ..... 415/106, 107, 108, 144, 145, 169.1, 415/198.1, 199.1–199.3, 901; 416/181, 416/231 R; 471/423.3, 424.1, 424.2; 166/105.5; 29/888.02, 888.024; 417/423.3, 424.1, 424.2
See application file for complete search history.

(56) References Cited

U.S. PATENT DOCUMENTS

| | | | | |
|---|---|---|---|---|
| 1,135,364 | A | 4/1915 | Doble | |
| 1,165,543 | A | 12/1915 | Sebald | |
| 1,541,171 | A | 6/1925 | Noble | |
| 3,116,696 | A | 1/1964 | Deters | |
| 3,171,355 | A | 3/1965 | Harris et al. | |
| 3,171,630 | A | 3/1965 | Harney et al. | |
| 3,300,950 | A | 1/1967 | Carle | |
| 3,624,822 | A | 11/1971 | Carle et al. | |
| 3,867,056 | A | 2/1975 | Carle et al. | |
| 4,892,459 | A | 1/1990 | Guelich | |
| 7,794,199 | B2 * | 9/2010 | Volk | 415/144 |
| 2011/0073305 | A1 | 3/2011 | Morrison, III | |

FOREIGN PATENT DOCUMENTS

| | | |
|---|---|---|
| EP | 0 437 070 | 3/1994 |

* cited by examiner

*Primary Examiner* — Christopher Verdier
(74) *Attorney, Agent, or Firm* — Faegre Baker Daniels LLP

(57) ABSTRACT

A submersible pump, and method of making the submersible pump, is disclosed. The pump comprises a housing, a plurality of impeller stages serially disposed in the housing from a bottom impeller stage to a top impeller stage, an impeller stage bypass hole extending through one of the diffusers and a housing bypass hole extending through the housing radially outwardly from one of the impeller stages.

19 Claims, 2 Drawing Sheets

BYPASS SYSTEM FOR PURGING AIR FROM A SUBMERSIBLE PUMP

CROSS-REFERENCE TO RELATED APPLICATION

This application is a continuation of U.S. patent application Ser. No. 11/411,348, entitled "BYPASS SYSTEM FOR PURGING AIR FROM A SUBMERSIBLE PUMP" filed Apr. 25, 2006, which claims priority of U.S. Provisional Patent Application No. 60/683,965, filed May 24, 2005, the disclosures of which are hereby expressly incorporated by reference herein in their entireties.

FEDERALLY SPONSORED RESEARCH OR DEVELOPMENT

Not Applicable.

TECHNICAL FIELD

This application relates to a submersible pump and, more particularly, to a bypass system for purging air from the submersible pump.

BACKGROUND OF INVENTION

Submersible pumps are used throughout the world to pump water out of various well configurations. A submersible pump typically has a plurality of impellers which work in series to develop pressure within the pump. The pressurized water is then expelled from the pump discharge and is therefore pressurized and available for usage. The installed system will continue to operate effectively as long as there is a sufficient supply of water which covers the suction intake of the pump. If the water level ever drops below the pump suction bracket for any length of time, the water in the pump may "leak" back out of the suction intake. This is a somewhat common occurrence in the water systems industry as the water tables across the U.S., and elsewhere, are constantly fluctuating. When the water well "recovers" (i.e., the water table rises), water once again surrounds the pump suction bracket and the pump should operate properly again.

The problem with many of these typical installations is that the water entering the well and surrounding the entire pump cannot always enter the hydraulics of the pump. Once air has been introduced into the pump assembly, there are no provisions for "purging" the air out of the pump in order to get the water into the hydraulics to move the water to displace the entrapped air. This detrimental condition of entrapped air in a submersible pump is identified by an industry used term called "air-lock" or "vapor-lock". The pump may continue to run without pumping any water, potentially leading to an eventual catastrophic failure of the entire pump system. This "air-lock" problem can occur in wells that contain high levels of Hydrogen Sulfide or other gasses as well. This gas can build up and displace the water in the hydraulic stages of the pump and cause a "vapor-lock" condition as well.

One prior method that has proven effective to prevent this anomaly is illustrated in FIG. 1, wherein a bypass hole 10 is located in the discharge head of a pump 12, or somewhere in the discharge piping (not shown) above a topmost impeller stage 14 of the pump 12. It is imperative that great care is taken in creating the bypass hole 10, as it must be located underneath a first check-valve (not shown) placed in the system. Because the bypass hole 10 is placed above all of the impellers of the pump, there is a great amount of performance lost because of the high pressure water exiting the pump through this hole.

It is an object of the invention to address this and other problems.

DETAILED DESCRIPTION OF THE INVENTION

Figure 3:
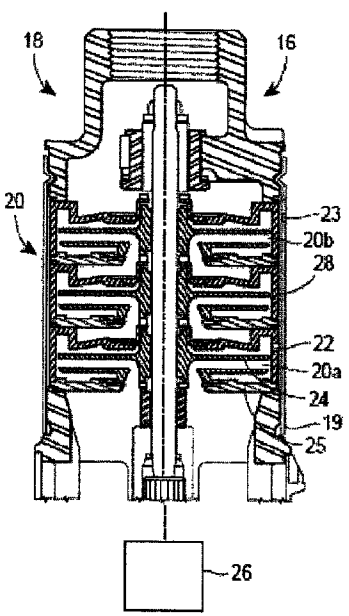
FIG. 3 is a sectional illustration of a second embodiment of a pump according to the present invention.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

The focus of this disclosure is a bypass system that allows entrapped air to exit a pump when a low-water condition presents itself. The additional benefit is that this bypass would have a minimal effect on the pump's performance. It is known in the industry that in order to purge the trapped air out of a submersible pump, you must be able to do one of two things: One must either submerse the pump in the well far enough below the water level so that the pressure differential created will force the air through the closed check-valve, or one must find a way to get water into the first stage of the pump.

When one gets water to the impeller eye in the first stage of a submersible pump, the impeller will create enough pressure to force the water into the impeller above it and so on.

Figure 2:
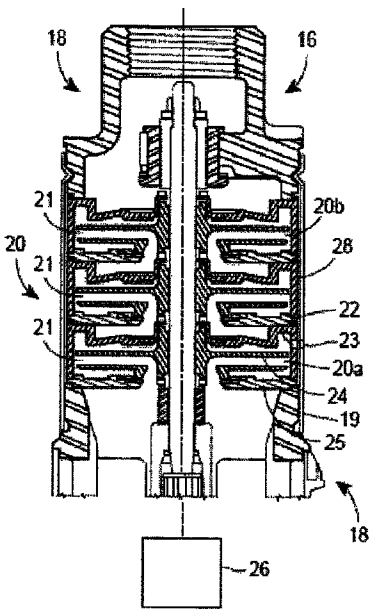
FIG. 2 is a sectional illustration of a first embodiment of a pump according to the present invention.
Figure 1:
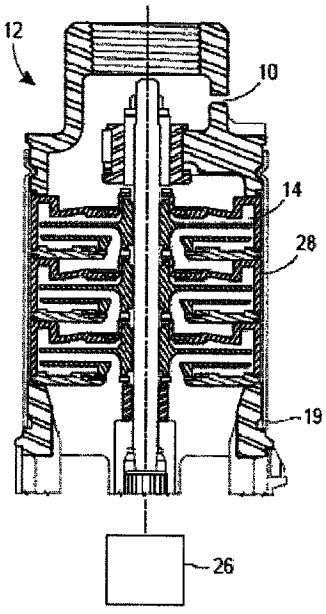
FIG. 1 PRIOR ART
FIG. 1 is a sectional illustration of a prior art pump.

A first embodiment of a submersible pumping system 16 according to the present invention is illustrated in FIG. 2. The pumping system 16 is for pumping water from a well (not shown). The pumping system 16 comprises a pump 18 comprising a housing 19, a plurality of impeller stages 20 serially disposed in the housing 19 from a bottom impeller state 20*a* to a top impeller stage 20*b*. Each of the impeller stages 20 has an impeller stage chamber 21, an impeller 24, and a diffuser 25. The pump 18 further includes an impeller stage bypass hole 22 extending through the diffuser 25 of the bottom impeller state 29*a*, and a housing bypass hole 23 extending through the housing 19 radially outwardly from the bottom impeller stage 20*a*. The pumping system 16 further comprises a submersible motor 26 operatively coupled to the pump 18.

Bypass holes placed in these locations allow for water to enter the pump and therefore successfully purge the air. The advantage of this bypass hole arrangement is that one does not lose the pressure generated by every successive stage in the pump, and the losses in the bottom-most stage are negligible. This bypass feature may be placed in any subsequent pump stage, however, performance will deteriorate as the impeller bypass moves upward in the pump. The size of the bypass holes also has a minimal effect on system performance. This would allow the feature to be large enough so that "clogging" would not be an issue as it is in the smaller hole at the top of the discharge head used in conventional systems.

A second embodiment is illustrated in FIG. 3. According to this embodiment, the impeller stage bypass hole 2 is formed in the diffuser 25 of the bottom impeller stage 20*a*, and the housing bypass hole 23 is formed in the housing 19 radially aligned with the upper impeller stage 20*b*. This configuration permits all of the impellers to fill with water, and it utilizes clearance 28 between the impeller stages 20 and the housing 19 to provide a passageway for the air to exit.

A method of making a submersible pump comprising forming an impeller stage bypass hole 22 through one of the diffusers 25 and forming a housing bypass hole 23 extending through the housing 19 radially outward one of the impeller stages 20. According to one aspect of the invention, the impeller stage bypass hole 22 is formed through the diffuser 25 of the bottom impeller stage 20*a*. According to one aspect of the invention, the housing bypass hole 23 is formed through the housing 19 radially outward from the bottom impeller stage 20*a*. According to another aspect of the invention, the housing bypass hole 23 is formed through the housing 19 radially outward from the top impeller stage 20*b*. According to yet another aspect of the invention, the impeller stage bypass hole 22 and the housing bypass hole 23 are formed in an axially spaced relationship.

Figure 4:
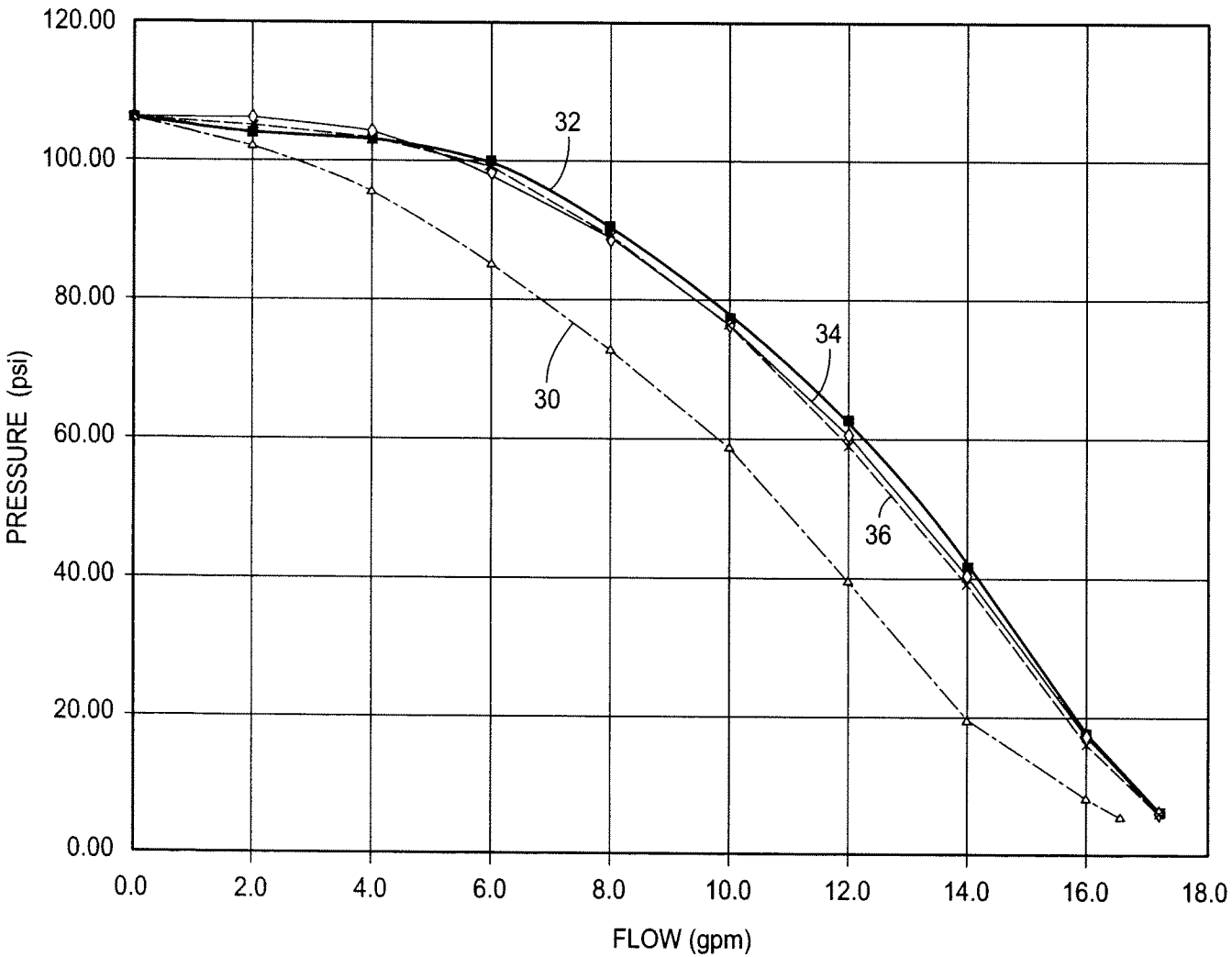
FIG. 4 is a graph illustrating pump performance of a prior art pump as well as of pumps according to the present invention.

FIG. 4 is a graph showing performance advantages of the first embodiment of the invention, both with a relatively small hole and with a relatively large hole, as compared to prior art systems either having no hole or a hole in the discharge head of the pump.

Line 30 illustrates a prior art pump having a bypass hole in the discharge head of the pump. Line 32 illustrates a prior art pump having no bypass hole. Line 34 illustrates a pump according to the first embodiment having a bypass hole approximately ⅛" in diameter. Line 36 illustrates a pump according to the first embodiment having a bypass hole approximately 3⁄16" in diameter. It can be seen that both versions of the first embodiment perform quite similarly to that of a prior art pump having no bypass holes.

From the foregoing, it will be observed that numerous variations and modifications may be effected without departing from the spirit and scope of the invention. It is to be understood that no limitation with respect to the specific apparatus illustrated herein is intended or should be inferred.

What is claimed is:

1. A bypass system for a submersible pump, the submersible pump including a housing, a plurality of impeller stages disposed in the housing and aligned in series from a bottom impeller stage to a top impeller stage, each of the impeller stages having a diffuser and an impeller, the system comprising:

an impeller stage bypass hole extending through a first diffuser of a first impeller stage of said plurality of impeller stages and a housing bypass hole extending through the housing radially outward from a second impeller stage and aligned with said second impeller stage, said impeller stage bypass hole in fluid communication with the housing bypass hole.

2. The bypass system of claim 1, wherein the first impeller stage comprises the bottom impeller stage and the impeller stage bypass hole extends through the bottom impeller stage.

3. The bypass system of claim 2, wherein the housing bypass hole extends through the housing radially outward from the top impeller stage.

4. The bypass system of claim 2, wherein the impeller stage bypass hole and the housing bypass hole are axially spaced.

5. The bypass system of claim 1, wherein the submersible pump includes an intermediate impeller stage positioned intermediate the bottom impeller stage and the top impeller stage.

6. The bypass system of claim 1, further comprising a passageway between the plurality of impeller stages and the housing and fluidly connecting the impeller stage bypass hole and the housing bypass hole for air to exit through the impeller stage bypass hole and the housing bypass hole.

7. The bypass system of claim 1, wherein the impeller stage bypass hole defines an entrance aperture and an exit aperture and extends through the diffuser, with the entrance aperture positioned radially outwardly from the impeller, whereby said entrance aperture of said impeller stage bypass hole is in fluid communication with an impeller stage flow path through one of the diffusers.

8. A submersible pump comprising:

a housing;

a plurality of impeller stages serially disposed in the housing from a bottom impeller stage to a top impeller stage, each of the impeller stages having an impeller in fluid communication with a diffuser to create an impeller stage flow path from the impeller through the diffuser for each of the impeller stages, the diffuser of each impeller stage in fluid communication with an adjacent impeller stage so that the impeller stage flow path of each impeller stage is in fluid communication with the impeller stage flow path of the adjacent impeller stage;

an impeller stage bypass hole extending through one of the diffusers in fluid communication with the impeller stage flow path of the one of the diffusers, the impeller stage bypass hole defining an entrance aperture and an exit aperture and extending through the diffuser, with the entrance aperture positioned radially outwardly from the impeller, whereby said entrance aperture of said impeller stage bypass hole is in fluid communication with the impeller stage flow path of the one of the diffusers; and a housing bypass hole extending through the housing radially outwardly from one of the impeller stages, said impeller stage bypass hole in fluid communication with the housing bypass hole.

9. The submersible pump of claim 8, wherein the impeller stage bypass hole extends through the diffuser of the bottom impeller stage.

10. The submersible pump of claim 8, wherein the housing bypass hole extends through the housing radially outward from the bottom impeller stage.

11. The submersible pump of claim 8, wherein the housing bypass hole extends through the housing radially outward from the top impeller stage.

12. The submersible pump of claim 8, wherein the impeller stage bypass hole and the housing bypass hole are axially spaced.

13. A submersible pumping system comprising the submersible pump of claim 8 in combination with a submersible motor operatively coupled to the pump.

14. The submersible pump of claim 8, whereby the impeller stage bypass hole extends through a first diffuser of a first impeller stage of said plurality of impeller stages and the housing bypass hole extends outward from a second impeller stage and aligned with the second impeller stage.

15. The submersible pump of claim 8, further comprising a passageway between the plurality of impeller stages and the housing and fluidly connecting the impeller stage bypass hole and the housing bypass hole for air to exit through the impeller stage bypass hole and the housing bypass hole.

16. A method of making a submersible pump, the pump including a housing, a plurality of impeller stages disposed in the housing and aligned in series from a bottom impeller stage to a top impeller stage, each of the impeller stages including a diffuser and an impeller, the method comprising:

forming an impeller stage bypass hole through a first diffuser of a first impeller stage of the plurality of impeller stages and forming a housing bypass hole extending through the housing radially outward of a second impeller stage and aligned with said second impeller stage, the impeller stage bypass hole in fluid communication with the housing bypass hole.

17. The method of claim 16, wherein the first impeller stage comprises the bottom impeller stage and the impeller stage bypass hole is formed through the bottom impeller stage.

18. The method of claim 16, wherein the housing bypass hole is formed through the housing radially outward from the top impeller stage.

19. The method of claim 16, wherein the impeller stage bypass hole and the housing bypass hole are formed in an axially spaced relationship.

* * * * *